US005692331A

United States Patent [19]

Tipke

[11] Patent Number: 5,692,331

[45] Date of Patent: Dec. 2, 1997

[54] VEHICLE-MOUNTED ADVERTISING SIGN

[76] Inventor: James Tipke, 321 N. Helena, Spokane, Wash. 99202

[21] Appl. No.: 451,455

[22] Filed: May 26, 1995

[51] Int. Cl.[6] ..... G09F 21/04

[52] U.S. Cl. ..... 40/591; 248/205.6

[58] Field of Search ..... 40/591; 248/205.6, 248/214, 222.51, 683; 362/80.1

[56] References Cited

U.S. PATENT DOCUMENTS

| | | | |
|---|---|---|---|
| 2,157,001 | 5/1939 | Morley | 248/205.6 |
| 2,752,709 | 7/1956 | Gough | 40/591 |
| 2,856,814 | 10/1958 | Dillmann | 248/205.6 X |
| 3,239,957 | 3/1966 | Snediker | 40/591 |
| 4,455,006 | 6/1984 | Aaserude | 248/205.6 |
| 4,583,310 | 4/1986 | Seiler | 40/591 X |
| 4,933,691 | 6/1990 | Leslie | 248/214 X |
| 5,084,994 | 2/1992 | Elmer | 40/591 |
| 5,210,970 | 5/1993 | Elmer | 40/591 |

*Primary Examiner*—Joanne Silbermann

*Attorney, Agent, or Firm*—Wells, St. John, Roberts, Gregory & Matkin, P.S.

[57] ABSTRACT

A vehicle window-mounted advertising sign for secure attachment of the advertising sign solely to the window and not requiring interface or support from the vehicle window frame. An upper window attachment includes an inner window surface mount arm which extends over the vehicle window and terminates in an inner window surface interface, combined with an outer window surface arm terminating in an outer surface interface, which when mounted on the vehicle window, impart both an inward and an outward force on the respective window surfaces, thereby securing the advertising sign to the window. Further in combination therewith is an angular adjustment feature which allows the angle of the advertising sign relative to the vehicle to be easily adjusted in an articulating manner to maintain optimum visibility and angle of the advertising sign.

1 Claim, 12 Drawing Sheets

VEHICLE-MOUNTED ADVERTISING SIGN

TECHNICAL FIELD

The present invention relates to vehicle-mounted advertising signs, more particularly for the secure attachment of advertising signs to vehicle windows without the need for the window to be completely rolled up.

BACKGROUND OF THE INVENTION

Since the late 1980s, vehicle-mounted advertising signs have been used by various businesses, particularly the pizza and other fast food businesses, for advertising and increasing notoriety and name recognition. The use of these signs can be particularly beneficial for businesses that deliver products to their customers, such as pizza delivery services, to make potential customers aware of the business, its presence in the area and that the business offers a delivery service.

Advertising signs have generally been mounted to vehicles by securing the sign to the roof of the vehicle or securing the sign by positioning it between a window and the window frame, and then rolling the window completely up. An example of one of these types of signs is set forth in U.S. Pat. No. 5,084,994, issued to Elmer.

Vehicle window-mounted advertising signs have generally used one or more suction cups to attach to the outer surface of the window, a brace and a hook portion to pass across the top of a vehicle window. In order for the prior window-mounted advertising signs to be securely fastened to the vehicle window while the vehicle is moving, the window must be completely rolled up such that the advertising sign is pinched between the window and the window frame of the vehicle. The window thereby pinched the hook portion of the mounting brace between the window and the door frame, thereby securely holding the sign to the vehicle, providing the necessary securement while the vehicle was moving.

With changes in automotive design such as frame-less windows and with changes in the angle or slope of the windows, existing sign braces and mechanisms for attaching the advertising sign to the window of the vehicle have become less effective or cannot be used on certain types of vehicles and windows.

Furthermore, even when existing window-mounted advertising signs are used, the driver of the vehicle is generally unable to roll the window down while the vehicle is moving because the advertising sign would not be sufficiently secure to be sure the sign would not come off when the vehicle is moving at higher vehicle speeds.

The need for effective and secure attachment of advertising signs to vehicle windows without the need to pinch part of the means to attach the sign to the vehicle between the window and the window frame has been recognized, but has not heretofore adequately been fulfilled by prior known attachment means.

Advances in vehicle design and shaping have further created varying and exaggerated angles at which windows are sloped. When a window-mount advertising sign is at a fixed angle relative to the means by which it is attached to the vehicle, while the vehicle windows are at varying angles, the advertising signs end up at varying slopes and angles relative to the ground and the effect of the advertising is diminished. Prior window-mounted advertising signs have utilized a mechanical screw mechanism which the operator must turn and which gradually changes the angle of the sign.

The need for an angularly adjustable window-mounted advertising sign which can more easily be adjusted by the operator merely grabbing the sign and manipulating it, but which is secure on the vehicle from wind forces while moving, has thus been recognized, but has not been adequately fulfilled.

FIG. 1 shows a rear view of a prior art window-mounted advertising sign mounted between the vehicle window and the vehicle frame member 3, including a vehicle door 1, a vehicle window 2 with an inner window surface **2*a* and an outer window surface 2*b*, upper window frame 3, brace 4, a support 5, an advertising member 6 and a suction cup 7. The upper portion of the brace 4*a* must be pinched between the window 2 and the upper window frame means 3** in order for the advertising sign to be secure while the vehicle is moving.

The forenamed recognized needs have not heretofore been sufficiently fulfilled by existing vehicle-mounted advertising signs.

The present invention solves the problems associated with the inability to mount advertising signs on vehicle windows unless the window is of a certain type or rolled completely up by providing a means by which the signs can be securely mounted to the window and need not necessarily be pinched between the window and the window frame.

The present invention fulfills this recognized need in a way that has the advantage of allowing advertising signs to be mounted merely on the window of the vehicle without the requirement that the window be completely rolled up and has the further advantage of being mountable on vehicles having different types of window frames and frameless windows.

The present invention solves the problems associated with varying angles and slopes of vehicle windows in a way that allows the advertising sign portion to be easily adjusted by the operator to accommodate the angle or slope of any vehicle window while still maintaining an upright and presentable advertising sign. The present invention provides for easy manipulation of the advertising sign by physically handling it and adjusting its relative angle in a relatively quick and simple way without the need to make slower mechanical adjustments.

BRIEF DESCRIPTION OF THE DRAWINGS

Preferred embodiments of the invention are described below with reference to the accompanying drawings, which are briefly described below.

FIG. 7 is a rear view of the articulation plate and the first vertical support;

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Many of the fastening, connection, process and other means and components utilized in this invention are widely known and used in the field of the invention described, their exact nature or type is not necessary for an understanding and use of the invention by a person skilled in the art or science, and they will not therefor be discussed in significant detail. Furthermore, the various components shown or described herein for any specific application of this invention can be varied or altered as anticipated by this invention and the practice of a specific application of any element may already be widely known or used in the art or by persons skilled in the art or science and each will not therefor be discussed in significant detail.

Figure 1:
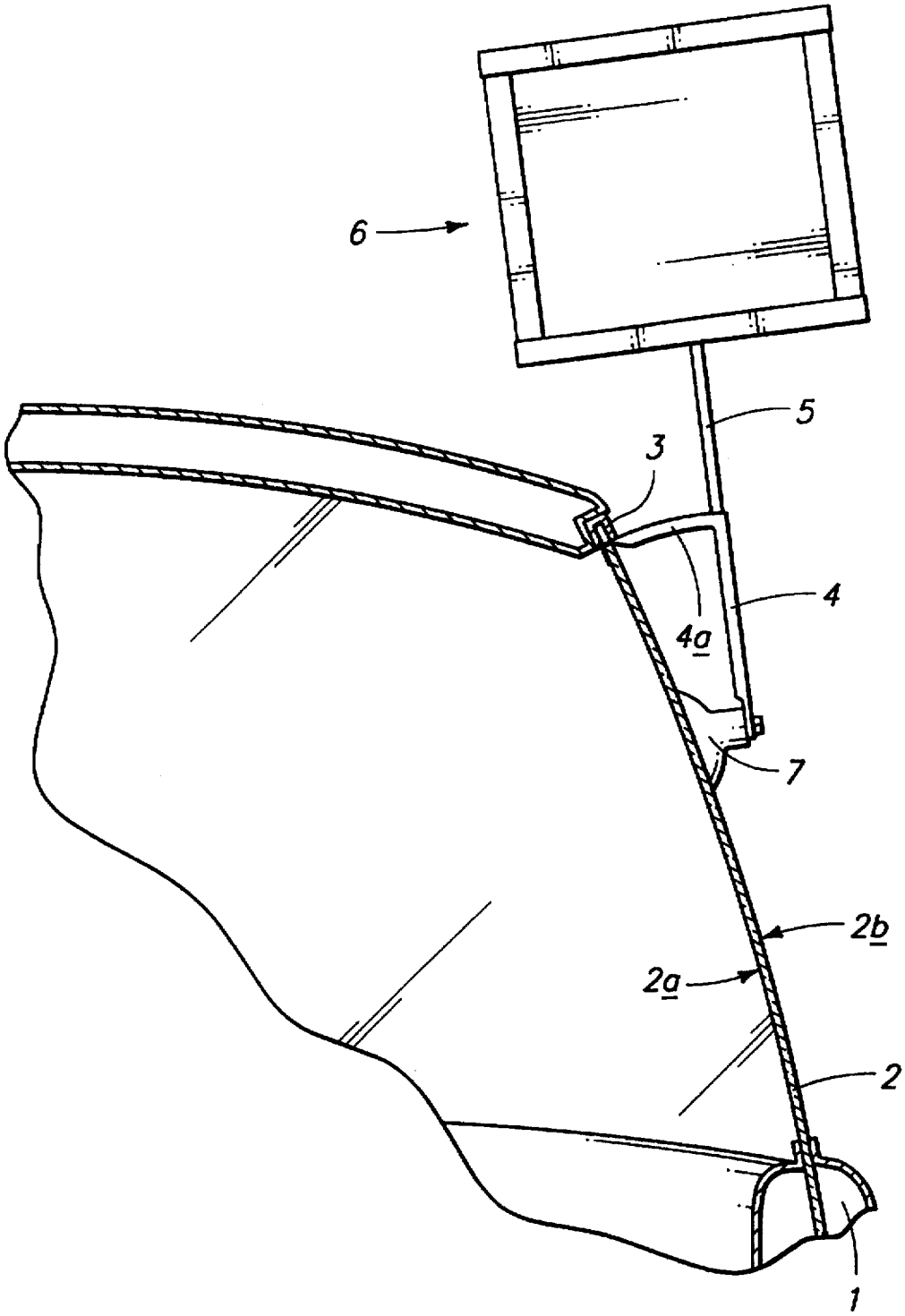
Fig 1 PRIOR ART
FIG. 1 is a rear view of a prior art window-mounted advertising sign.
Figure 2:
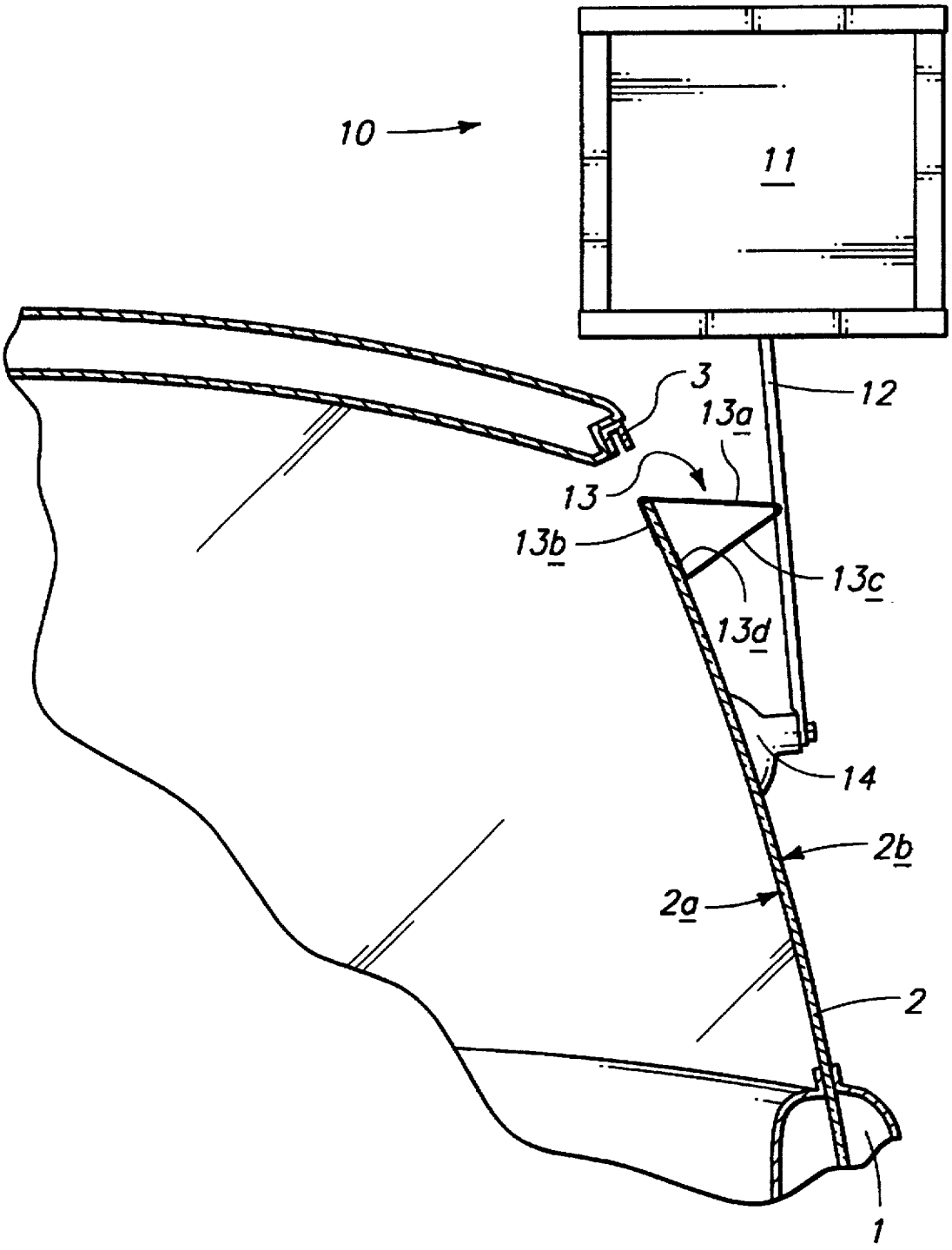
FIG. 2 is a rear view of one embodiment of the invention mounted on a vehicle window.

The relevant portions of a vehicle are shown in FIG. 2 and include the vehicle door 1, a vehicle window 2, with an inner window surface **2*a* and an outer window surface 2*b*, and an upper window frame 3**.

The embodiment of the invention illustrated in FIG. 2 shows a rear advertising surface 11 to the advertising member 10, an advertising member support 12, a window attachment 14, a suction cup, and the upper window attachment 13.

The upper window attachment embodiment shown in FIG. 2 includes an inner surface mount arm **13*a*, an inner window surface interface 13*b*, an outer window surface arm 13*c*, and outer window surface interface 13*d***.

Figure 3:
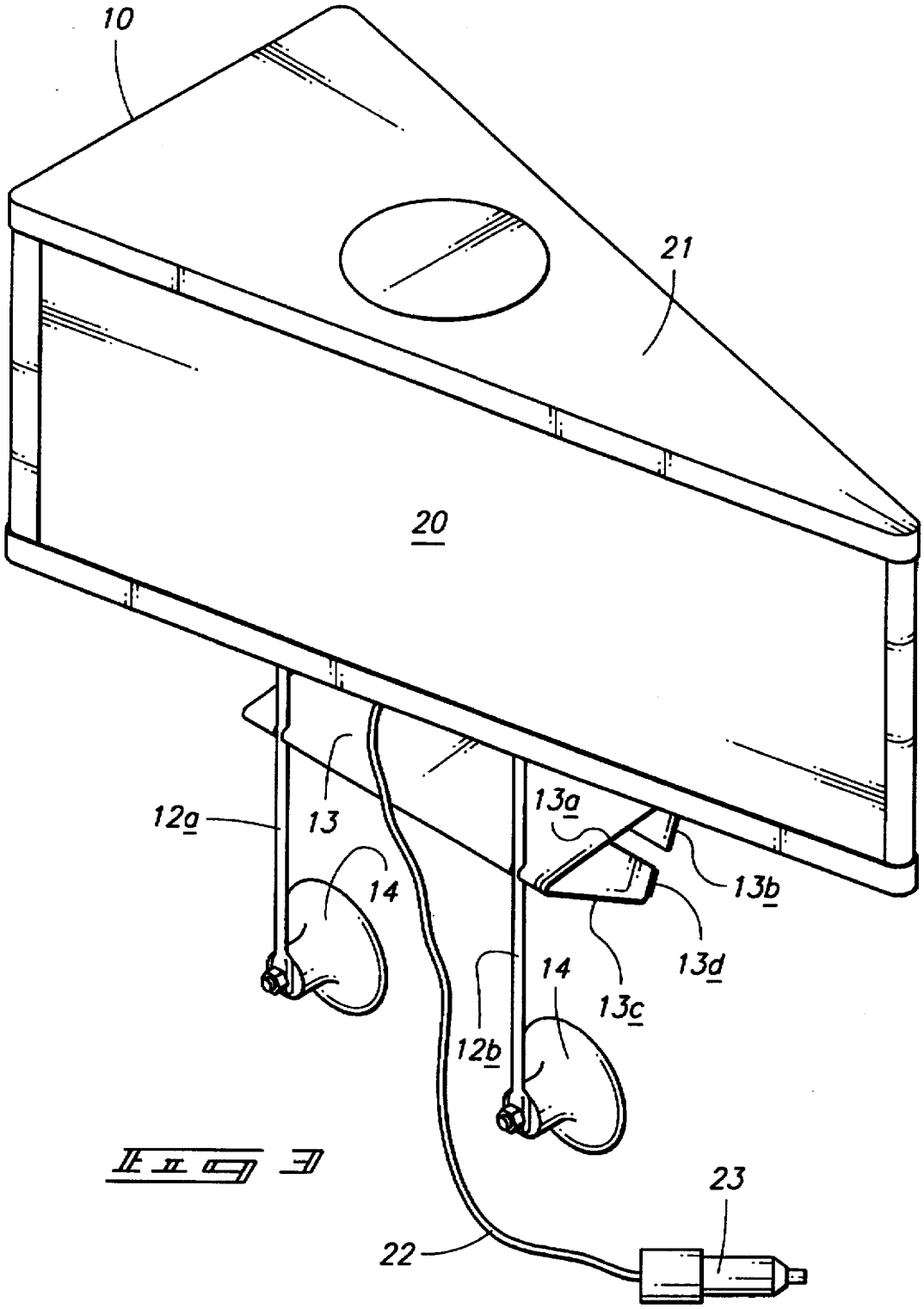
FIG. 3 is a perspective view of one embodiment of the invention.

The embodiment of the invention illustrated in FIG. 3 is a perspective view of a 3-sided advertising member 10, with a side surface 20 and a top member 21. For use of the invention during non-daylight hours, lights can be installed within the advertising member 10 and electricity for said lights can be obtained from the cigarette lighter of the vehicle by extending cord 22 into the vehicle and utilizing adapter 23, through which to receive the electricity.

FIG. 3 further illustrates an embodiment of the invention wherein 2 vertical supports are utilized, namely: a first vertical support **12*a* and a second vertical support 12*b***.

Figure 4:
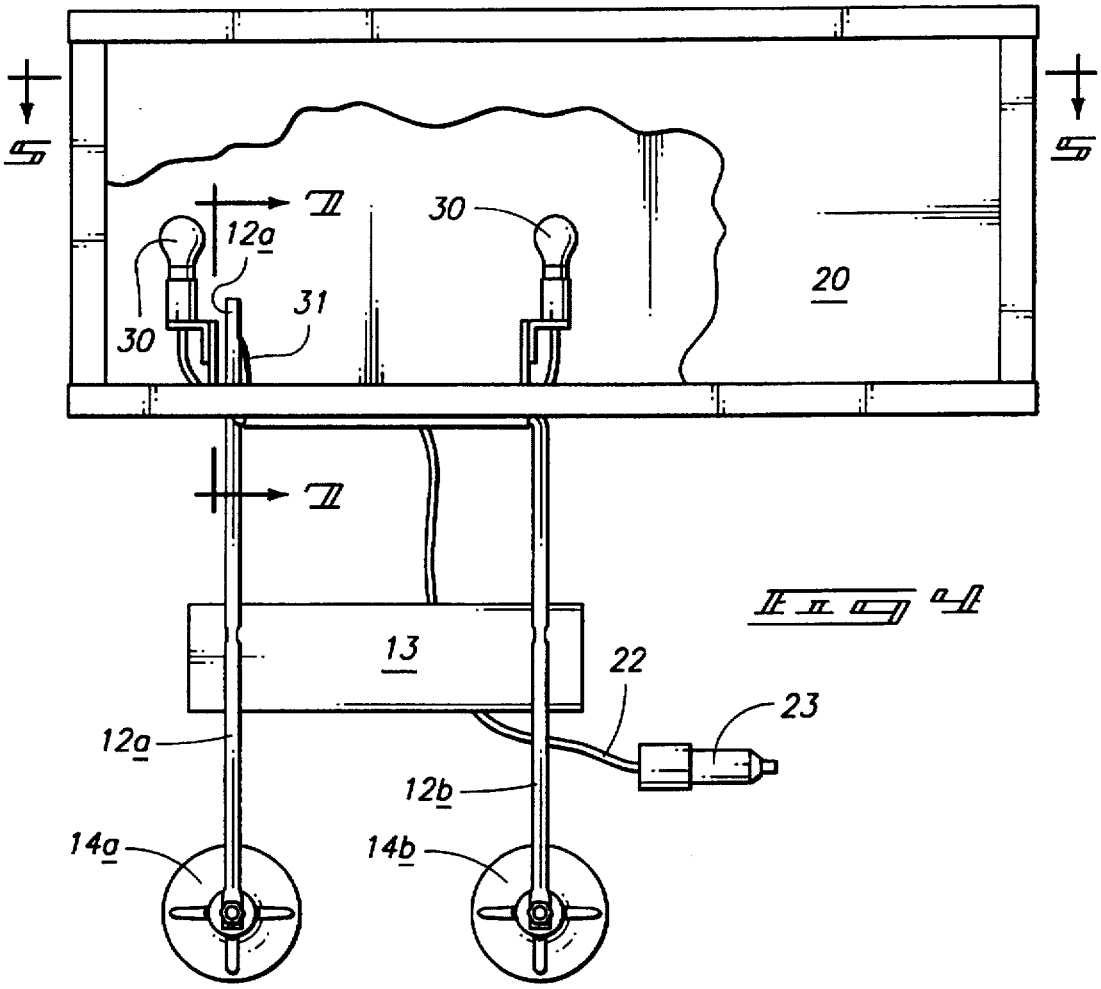
FIG. 4 is a plan elevation view of one embodiment of the invention.

FIG. 4, a plan elevation view of one embodiment of the invention, further illustrates the interior lights 30 that can be used within the advertising member 10. FIG. 4 further illustrates a first vertical support **12*a* connected to a window attachment, which in the illustrated embodiment is a first suction cup 14*a*. A second vertical support 12*b* is likewise shown attached to a second suction cup 14*b***.

Figure 5:
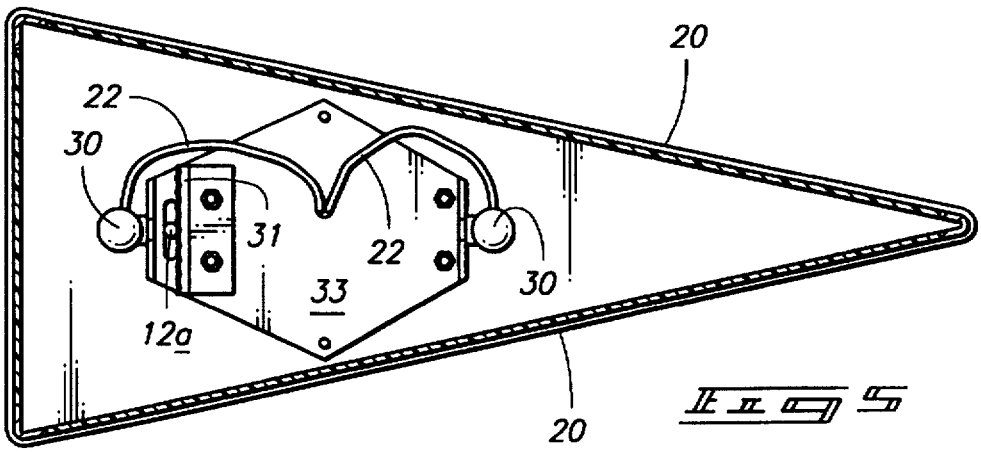
FIG. 5 is a top view of one embodiment of the invention.

FIG. 5 is a top view of one embodiment of the invention and shows a support plate mounting means 33 for interior advertising member structure to mount to the advertising member support. Further shown in FIG. 5 is the articulation plate 31 in bias contact with first vertical support **12*a***.

Figure 6:
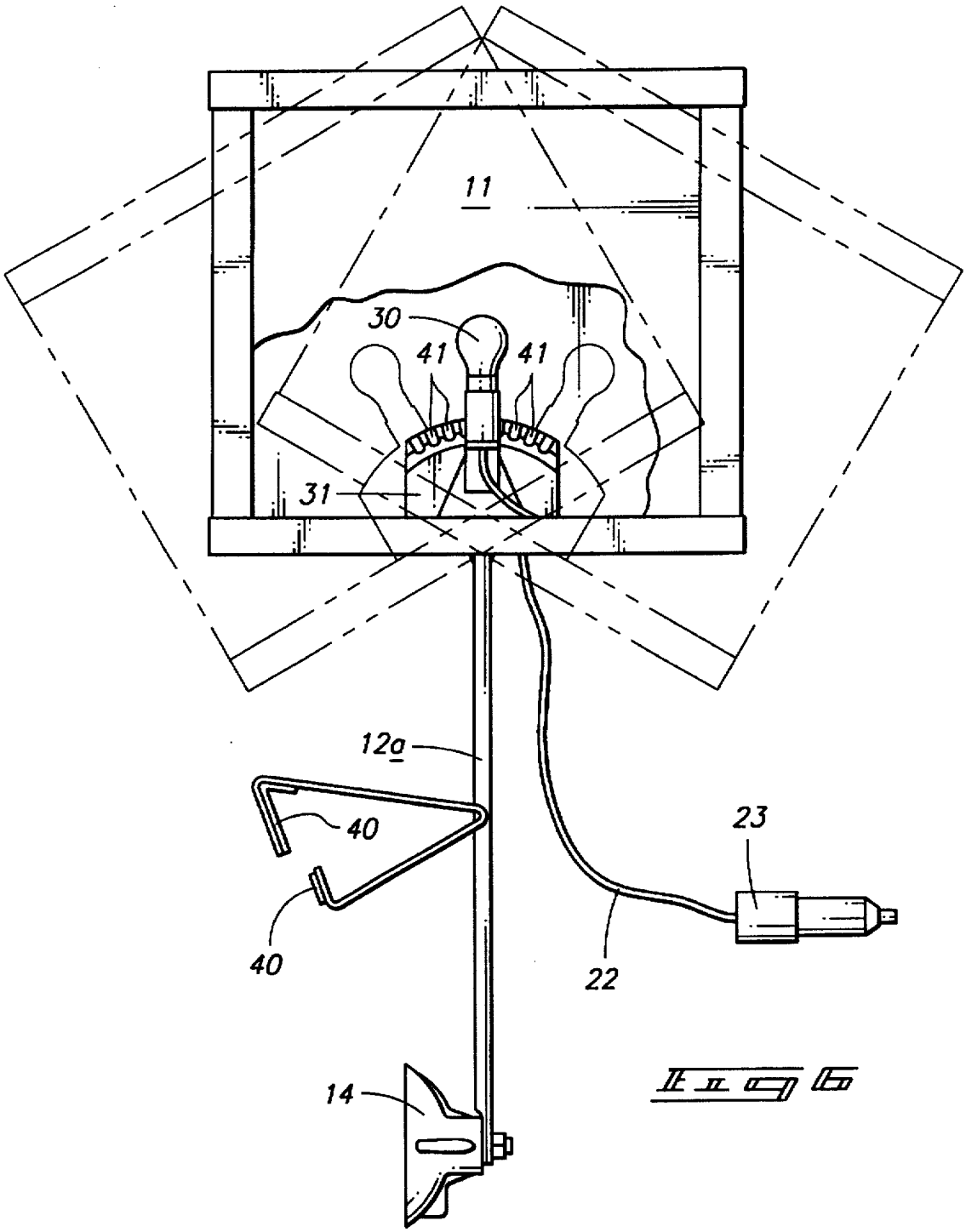
FIG. 6 is a rear view of one embodiment of the invention, illustrating the advertising member being pivoted about a horizontal longitudinal axis.

FIG. 6 illustrates the advertising member pivoting about a horizontal longitudinal axis and relative to the first vertical support **12*a* and to the second vertical support 12*b*. FIG. 6 further shows a friction buffer 40 attached to the upper window attachment and which, when mounted on a vehicle window, serves to increase the friction between the upper window attachment and the vehicle window and to provide a padding to avoid damaging the vehicle window. The friction buffer 40** can be a number of different materials, such as neoprene rubber, or others.

Figure 12:
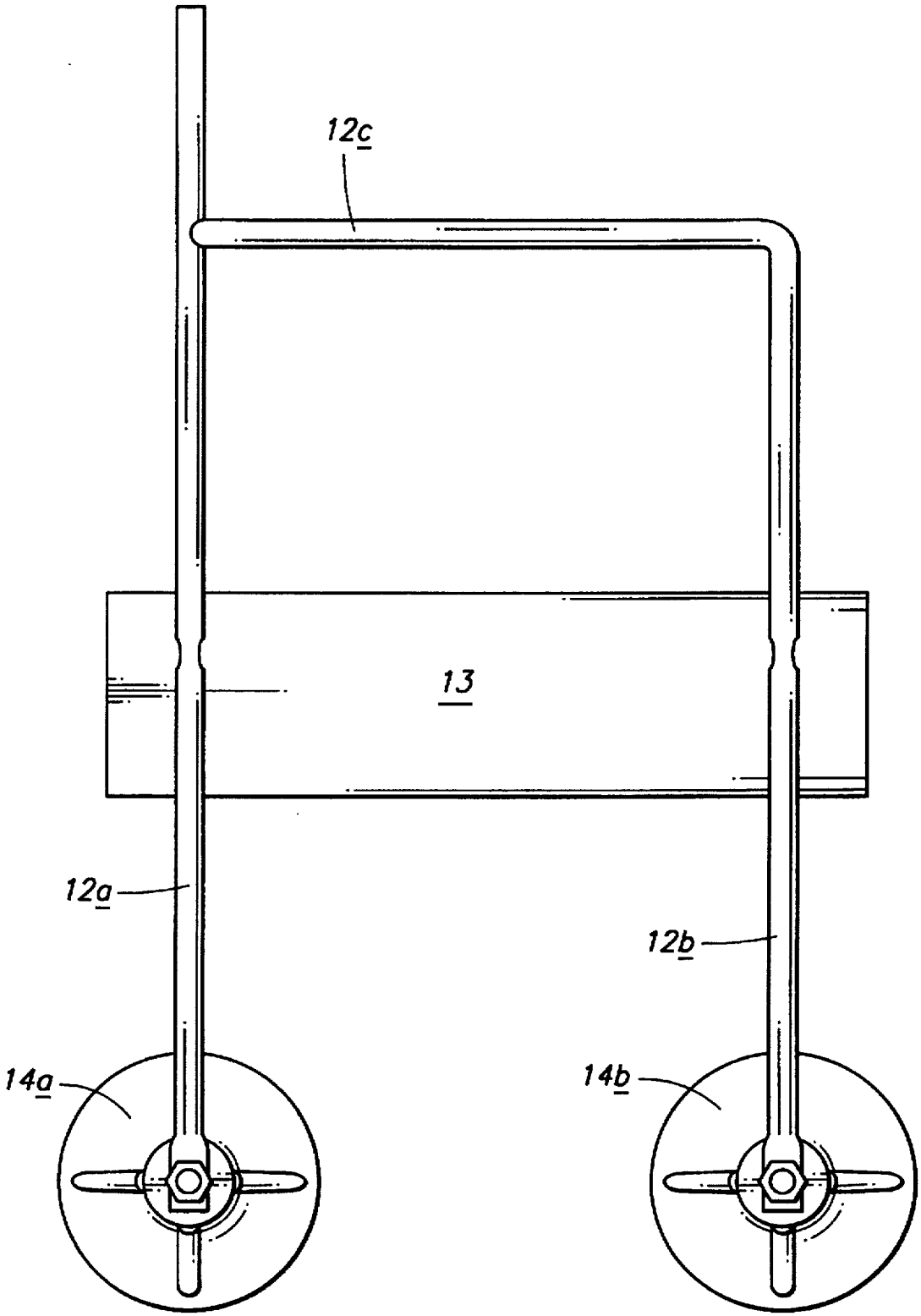
FIG. 12 is a section view from direction 7—7 in FIG. 4, which illustrates the horizontal pivoting mechanism and the vertical support structure.

FIG. 6 further shows the indents 41 in the articulation plate 31, which are biased towards and allow for articulation with the first vertical support **12*a*, as further illustrated and described in relation to FIG. 12**.

FIG. 7 illustrates the interaction between the first vertical support **12*a*, the articulation plate 31, and the indents 41 on the articulation plate. When the advertising member is physically manipulated, it can be rotated about a horizontal longitudinal axis and the first vertical support 12*a* will articulate from indent 41 to indent 41. When the first vertical support 12*a* is in any particular indent 41, there is sufficient contact bias between the articulation plate 31 and the first vertical support 12*a*** such that the advertising member is secure at the angle at which it is placed.

Figure 8:
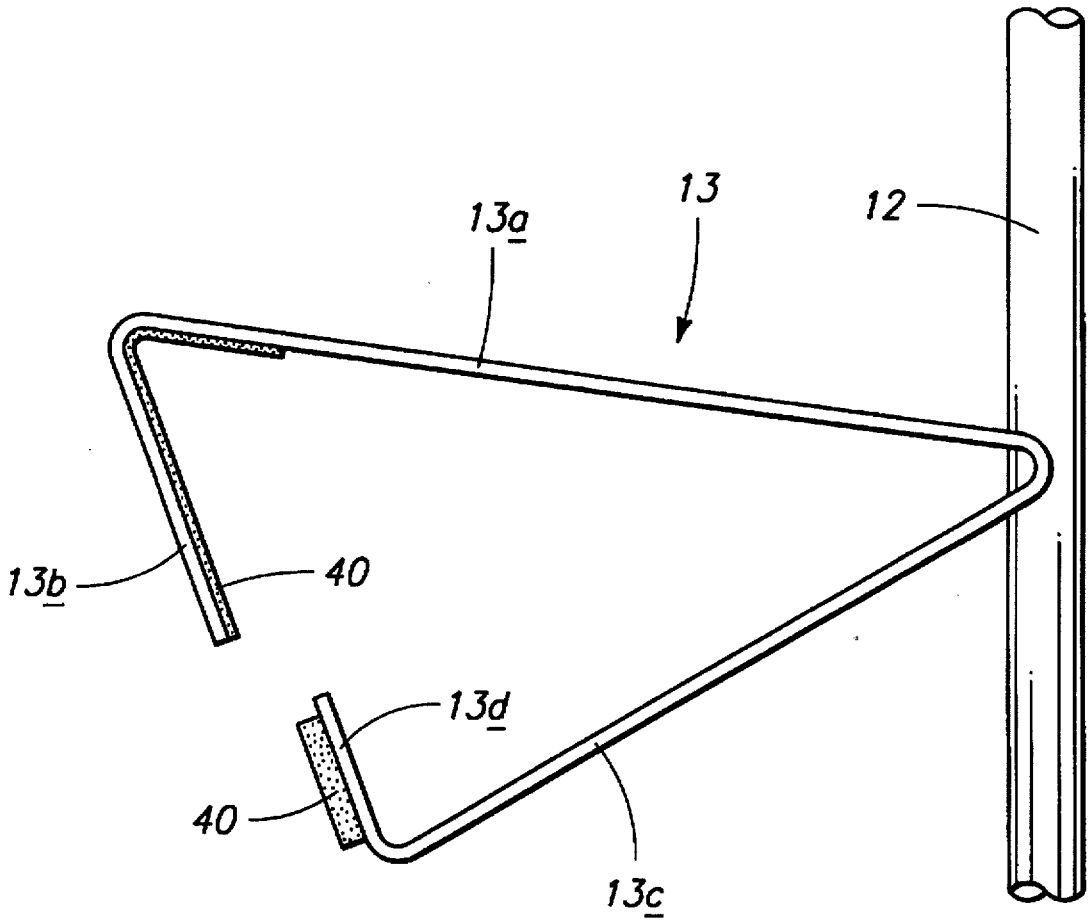
FIG. 8 is a view of one embodiment of the upper window attachment.

FIG. 8 illustrates the preferred embodiment for the upper window attachment 13, the embodiment shown being a single metallic sheet bent as shown. The inner window surface mount arm **13*a* terminates in the inner window surface interface 13*b*, and illustrates a friction buffer 40 attached thereto. The outer window surface arm 13*c* terminates in the outer window surface interface 13*d* also with a friction buffer 40** attached thereto.

When the vehicle window is positioned between the inner window surface interface and the outer window surface interface, and the window attachment or suction cups are attached to the window, a tension created by the configuration of the upper window attachment imparts an outward force on the inner window surface interface **13*b* to the window. Concurrently, the outer window surface interface 13*d*** imparts an inward force on the vehicle window. The combination of the inward and the outward force on the vehicle affectively secures the upper window attachment to the vehicle window.

The friction buffer 40 further serves to avoid any relative sliding between the vehicle window and the upper window attachment and assist in further securement of the upper window attachment to the vehicle window.

Figure 9:
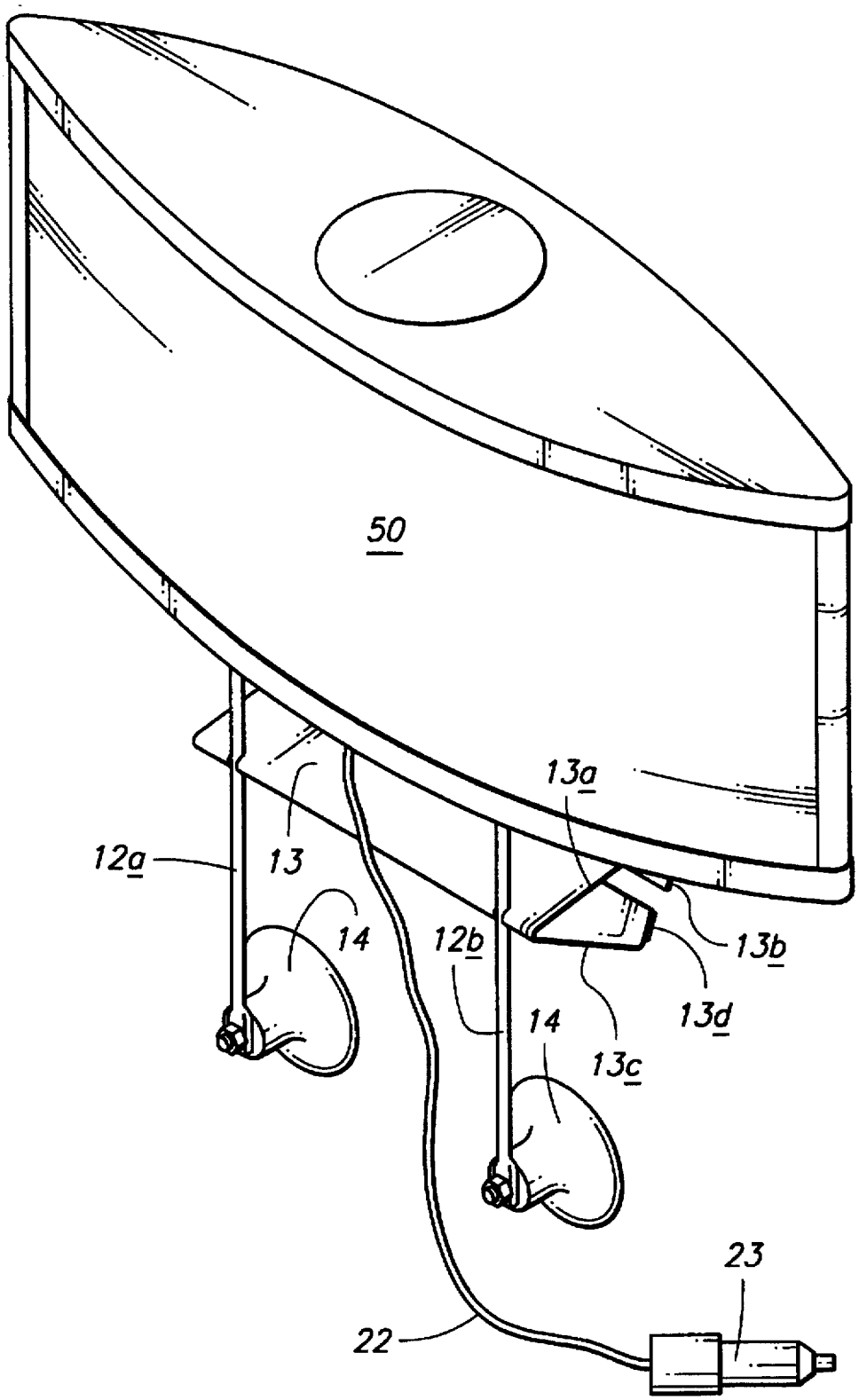
FIG. 9 is a perspective view of an embodiment of the invention with a canoe-shaped advertising member.

FIG. 9 shows a perspective view of a canoe-shaped advertising member with two corresponding sides 50 for placement of the advertising medium desired.

Figure 10:
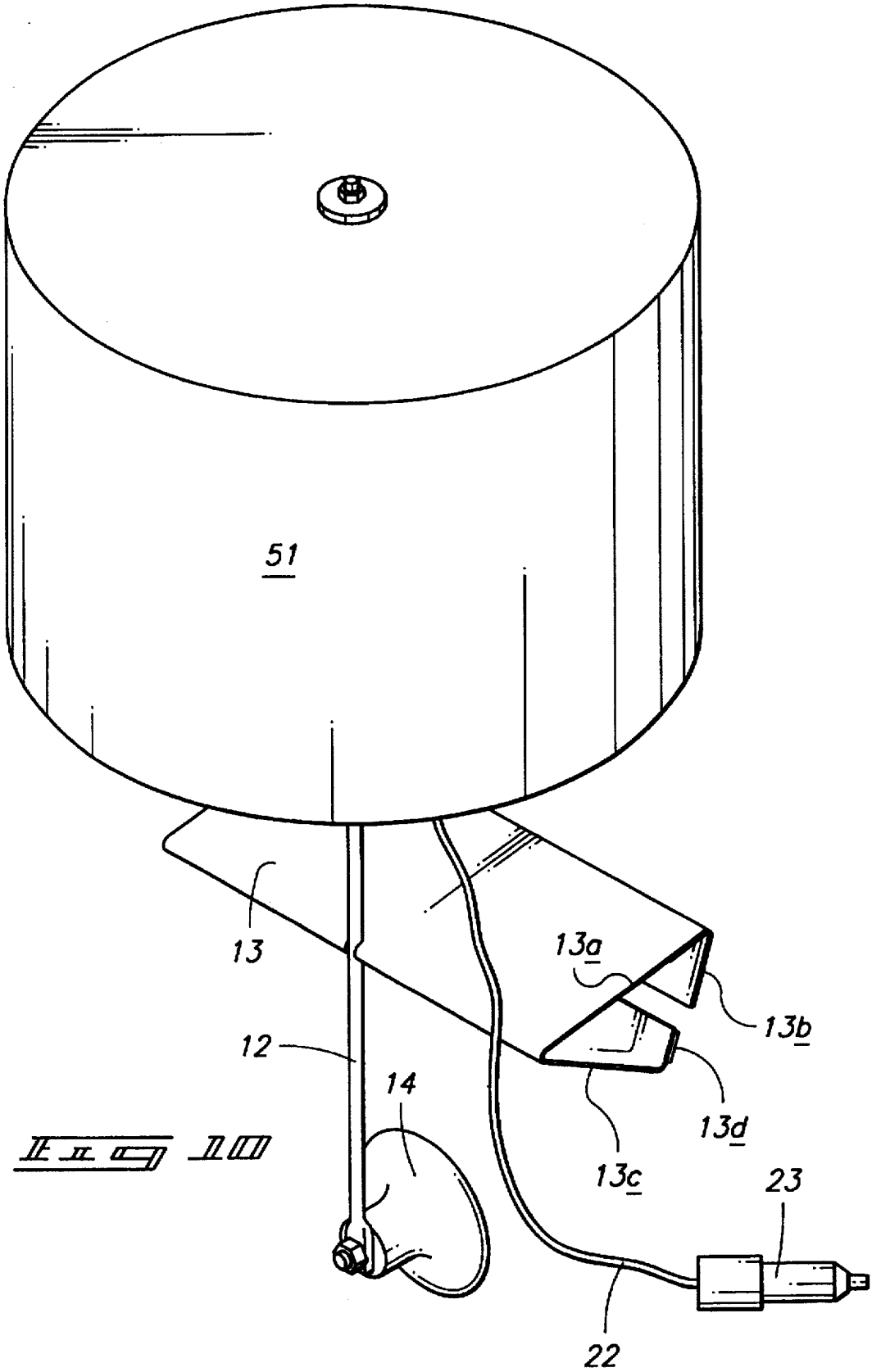
FIG. 10 is a perspective of one embodiment of the invention with a circular-shaped advertising member.
Figure 11:
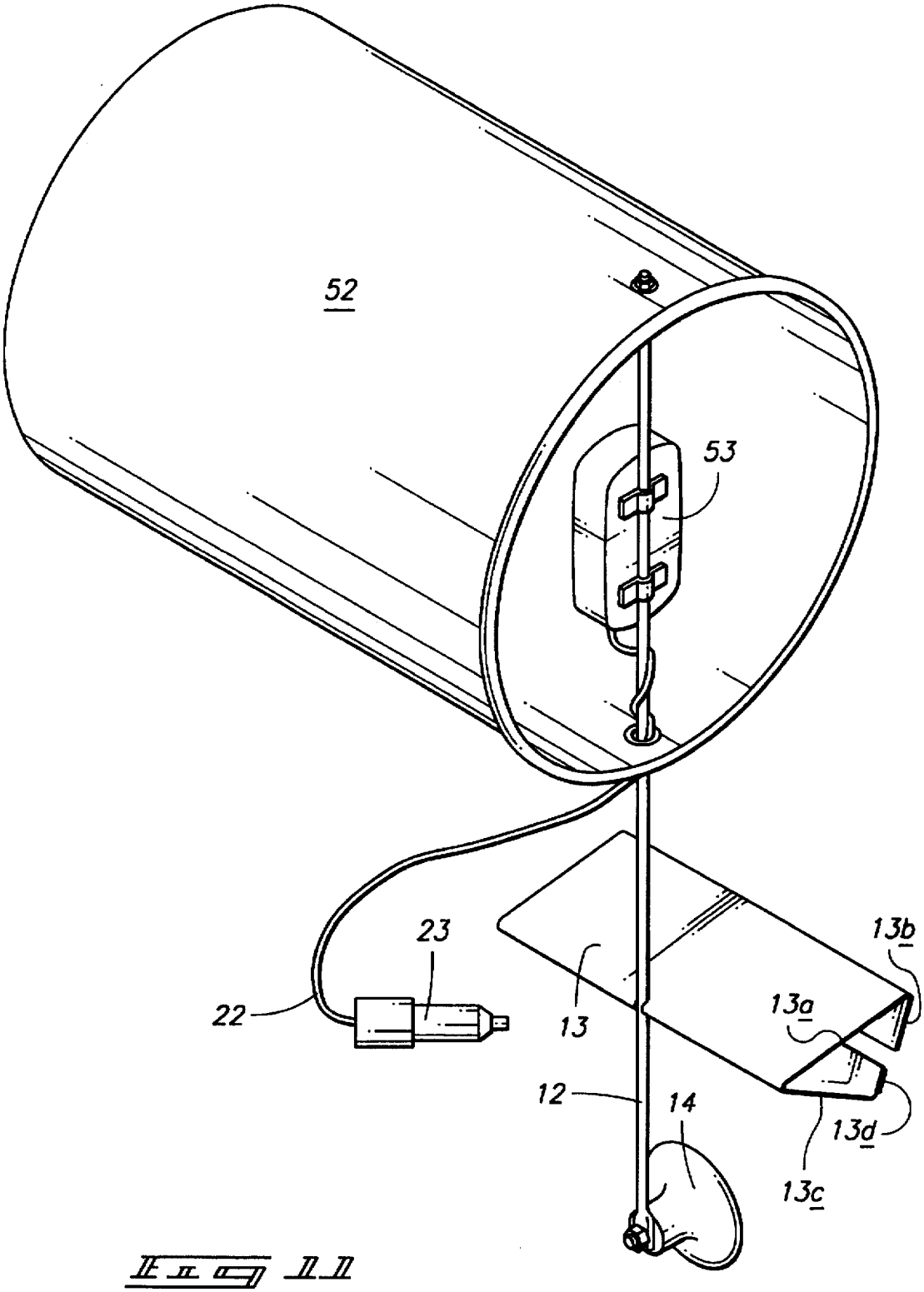

FIG. 10 illustrates a circular advertising member with outer surface 51 on which a suitable advertising medium can be placed.

Figure 11:
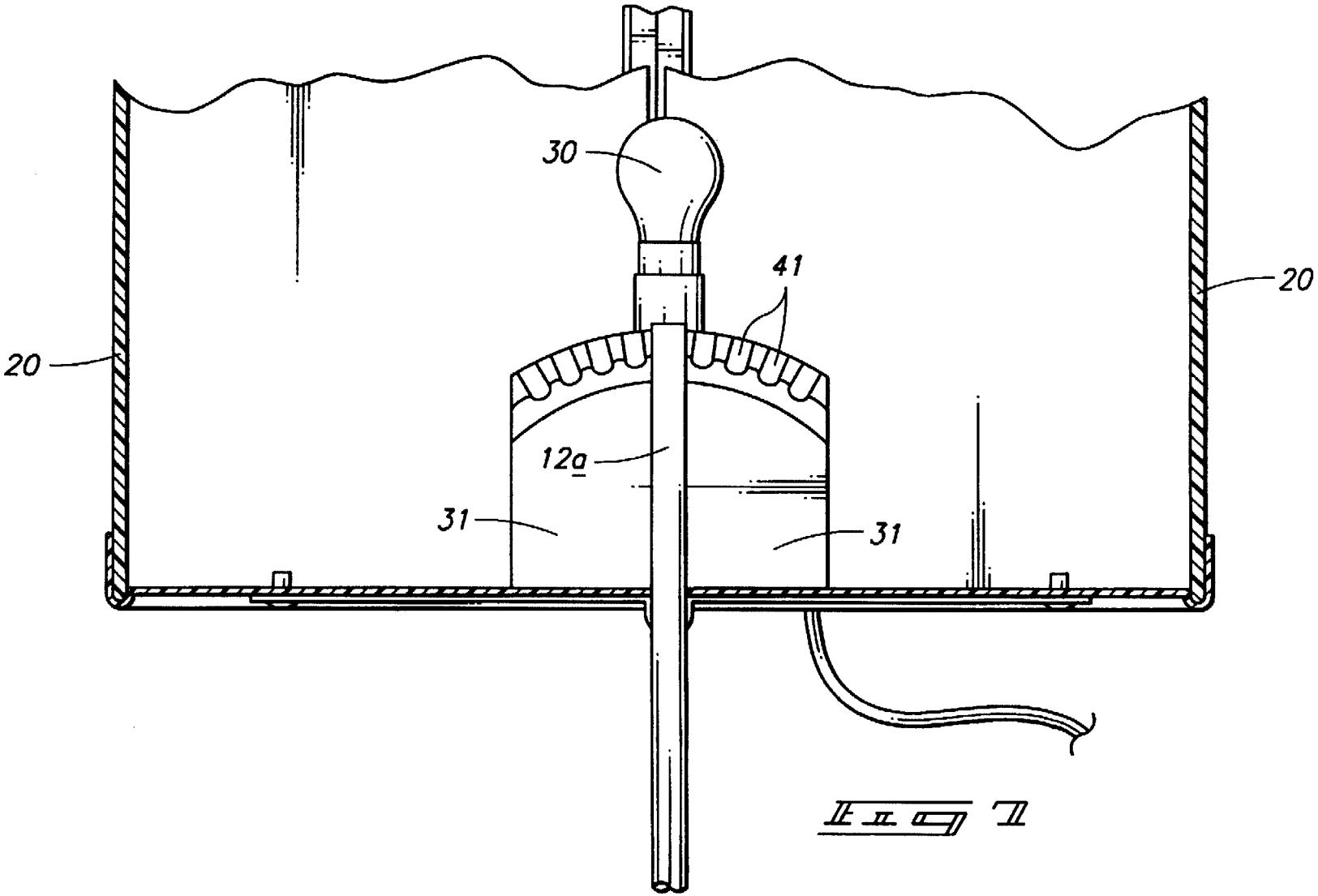
FIG. 11 is a perspective view of one embodiment of the invention with a windsock as the advertising member.

FIG. 11 shows a windsock embodiment of the invention with a single vertical advertising member support 12. The outer surface of the windsock 52 is where the desired advertising medium can be placed. FIG. 11 further illustrates how a lighting means 53 can be mounted on advertising support member 12 to provide an illuminated advertising medium.

FIG. 12 illustrates the preferred embodiment of the advertising member support 12, with a first vertical support **12*a* and a second vertical support 12*b*. The second vertical support 12*b* is shown bent to includes a horizontal portion 12*c* and terminating in a connection to the first vertical support 12*a*. A sleeve from the advertising member surrounds and thereby creates the horizontal longitudinal axis about which the advertising member 10 can be pivoted relative to the advertising member support 12** and the vehicle.

Figure 13:
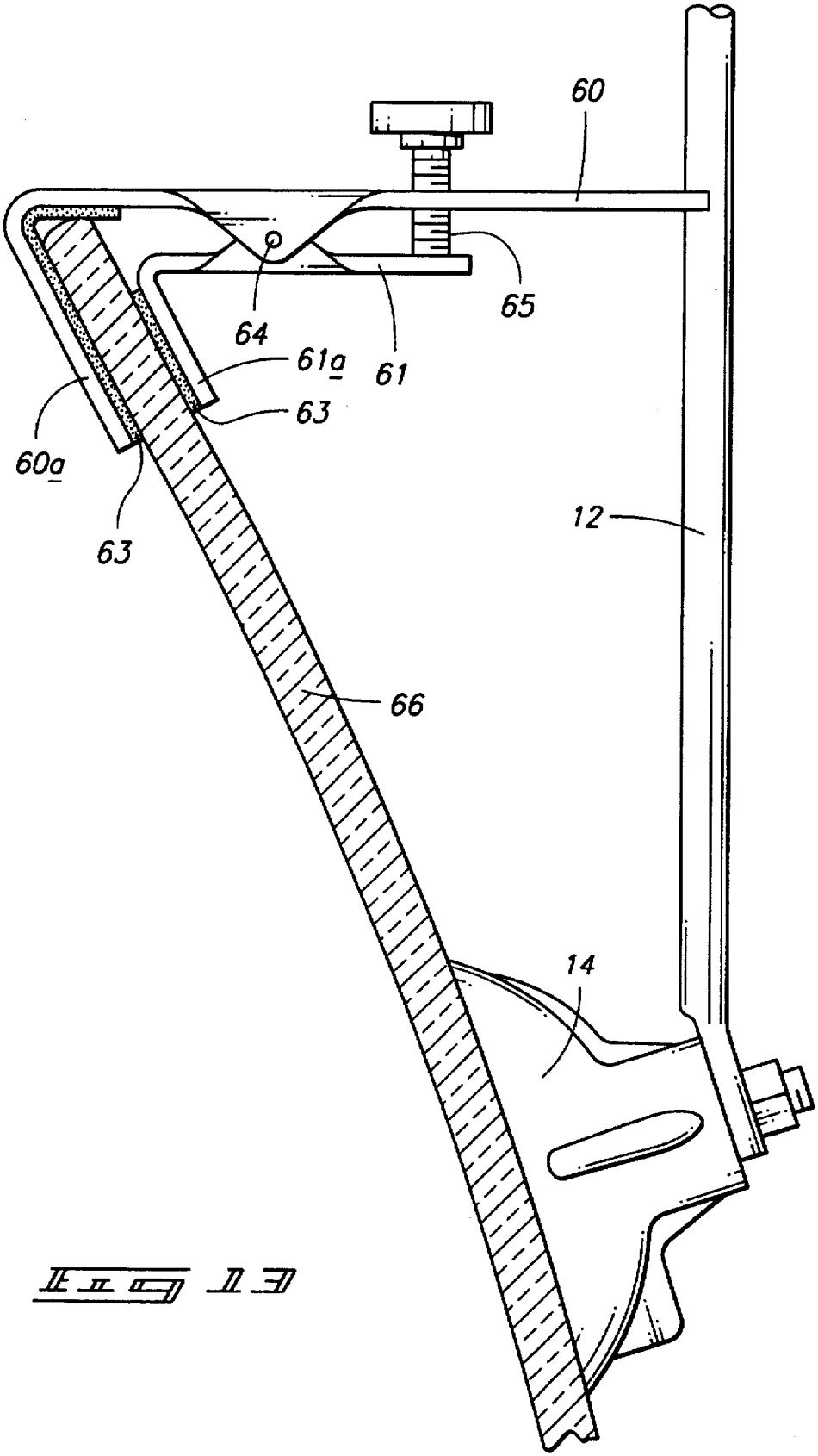
FIG. 13 is a side view of another embodiment of the invention wherein only one arm including two window interfaces is utilized.

FIG. 13 illustrates another embodiment of the invention wherein only one support arm 60 with an inner window surface interface 60*a* and a friction buffer 63 attached thereto and positioned between the interface 60 and the vehicle window 66. The single support arm 60 is attached to advertising member support 12, which terminates at suction cup 14, a window attachment means.

Although the outer window surface interface 61 is shown pivotally connected to the support arm 60, it can also be fixed to achieve a sufficiently secure fit to hold the advertising sign on the window while the vehicle is traveling. Friction buffer 62 is attached to the second end of outer window surface interface 61*a*.

Screw 65 is threaded through support arm 60 and abuts outer window surface interface 61 such that when it is turned it imparts a force on the outer surface of the vehicle window 66 through the second end of outer window surface interface 61*a*. Imparting a force from screw 65 causes outer window surface interface 61*a* to pivot about axis 64, thereby causing second end 61*a* to impart an inward force on the outer window surface.

In compliance with the statute, the invention has been described in language more or less specific as to its features. It is to be understood, however, that the invention is not limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. An apparatus for displaying advertising on a vehicle and which releasably attaches to a vehicle window, the vehicle window having an inner window surface and an outer window surface, and which comprises:

a. an advertising member with one or more side surfaces to which an advertising medium can be affixed;

b. advertising member supports which include a first vertical support which extends into the advertising member and a second vertical support pivotally attached such that the advertising member may be pivoted about a horizontal longitudinal axis and relative to the second vertical support to the advertising member, the advertising member further comprising:

an articulation plate in biased contact with the first vertical support, the articulation plate including a plurality of indents complimentary to the first vertical support, such that when the advertising member is rotated about the horizontal longitude axis, the first vertical support articulates from indent to indent in the articulation plate;

c. a first window attached to a lower end of the first vertical support and a second window attachment attached to a lower end of the second vertical support, which releasably attach to the outer window surface; and d. an upper window attachment connected to the advertising member supports, the upper window attachment being a single metallic sheet bent such that it is comprised of i. an inner surface support arm which terminates in an inner window surface interface with a friction buffer, which is a parallel to the inner window surface, which when mounted on a vehicle window, imparts an outward force on an inner window surface, and ii. an outer surface support arm which terminates in an outer window surface interface with a friction buffer, which is parallel to the outer window surface, which when mounted on a vehicle window, imparts a inward force on the outer window surface, thereby securing the upper window attachment to a vehicle window.

* * * * *